US005102118A

United States Patent [19]

Vits

[11] Patent Number: 5,102,118

[45] Date of Patent: Apr. 7, 1992

[54] DEVICE FOR FLOATABLY GUIDING WEBS OR SHEETS OF MATERIAL TO BE CONVEYED

[76] Inventor: Hilmar Vits, Hüschelrath 16, D-5653 Leichlingen, Fed. Rep. of Germany

[21] Appl. No.: 608,161

[22] Filed: Nov. 1, 1990

[30] Foreign Application Priority Data

Nov. 6, 1989 [DE] Fed. Rep. of Germany ..... 3936846

[51] Int. Cl.[5] ..... B65H 29/24

[52] U.S. Cl. ..... 271/195; 406/88; 239/559; 226/97; 414/676

[58] Field of Search ..... 271/194, 195, 196, 211; 406/86, 88, 89; 239/559; 226/97; 414/676

[56] References Cited

U.S. PATENT DOCUMENTS

| | | | |
|---|---|---|---|
| 3,477,764 | 11/1969 | Smith . | |
| 4,218,001 | 8/1980 | Vits | 226/97 |
| 4,437,612 | 3/1984 | Russ et al. | 226/97 X |
| 4,500,229 | 2/1985 | Cole et al. . | |
| 4,688,784 | 8/1987 | Wirz | 271/195 |
| 4,828,434 | 5/1989 | Fairman et al. | 406/88 |

FOREIGN PATENT DOCUMENTS

| | | |
|---|---|---|
| 0249414 | 12/1987 | European Pat. Off. . |
| 1449656 | 6/1972 | Fed. Rep. of Germany . |
| 1907083 | 12/1975 | Fed. Rep. of Germany . |
| 7209551 | 11/1972 | France . |
| 2294965 | 7/1976 | France . |

*Primary Examiner*—H. Grant Skaggs
*Assistant Examiner*—Carol L. Druzbick
*Attorney, Agent, or Firm*—Marmorek, Guttman & Rubenstein

[57] ABSTRACT

A device for floatably guiding webs or sheets of material to be conveyed by means of nozzles supplying blown air comprises a nozzle body having at least one nozzle aperture on which a jet of blowing air emerges, and a deflecting surface disposed countersunk in the nozzle body and inclined towards the outside of the nozzle body. The deflecting surface is part of the generated surface of a conical depression in the nozzle body, and a nozzle aperture is disposed eccentrically in the conical depression so that the direction of the blowing air jet is directed towards the deflecting surface at a blowing angle which is from less than 90° to parallel with the deflecting surface.

11 Claims, 3 Drawing Sheets

Figure 5:
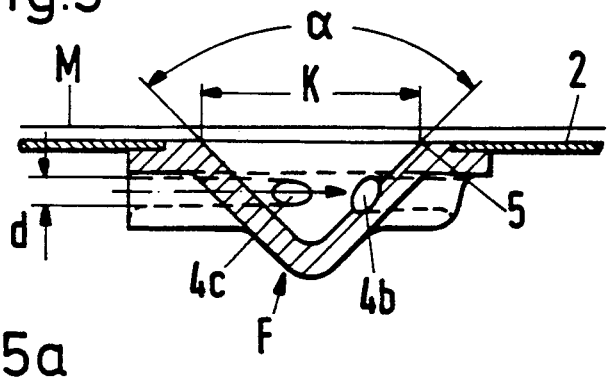

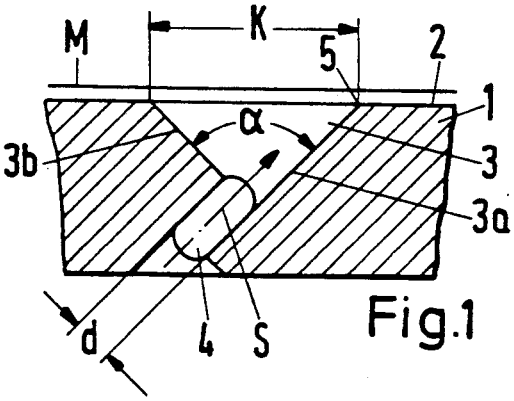
Fig.1
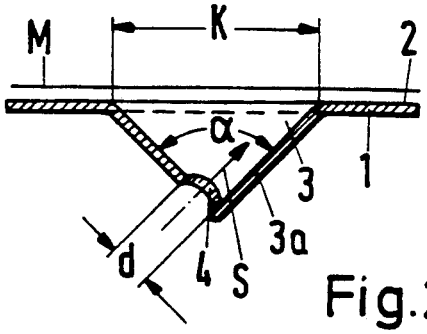
Fig.2
Fig.2a
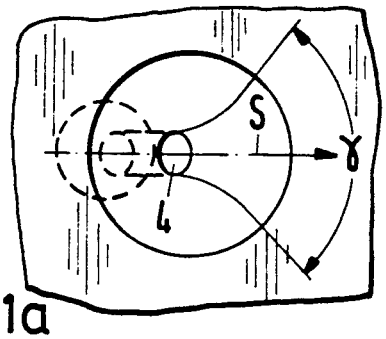
Fig.1a
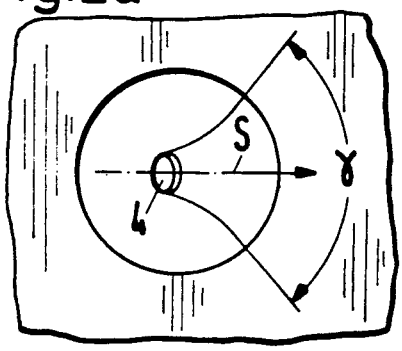
Fig.4
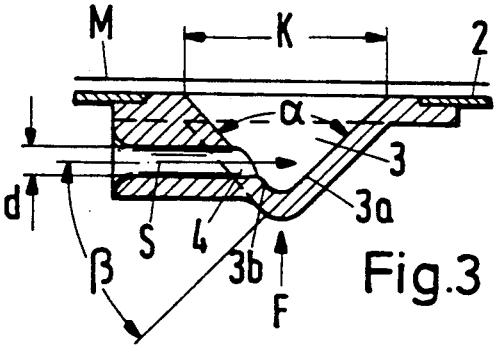
Fig.3
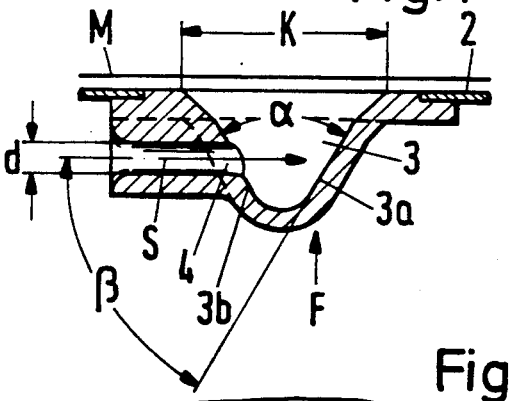
Fig.4a
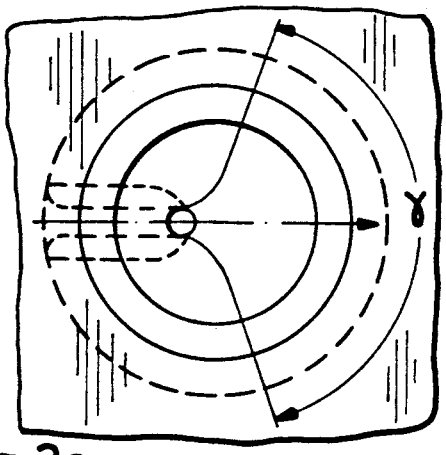
Fig.3a
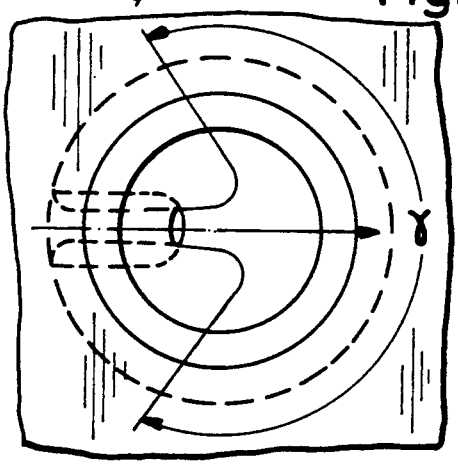

DEVICE FOR FLOATABLY GUIDING WEBS OR SHEETS OF MATERIAL TO BE CONVEYED

The invention relates to a device for floatably guiding webs or sheets of material to be conveyed, using nozzles supplied with blowing air which are disposed in a nozzle body and each have for the jet of blowing air emerging from the nozzle aperture a deflecting surface disposed countersunk in the nozzle body and inclined towards the outside of the nozzle body.

A number of objectives must be met independently or in combination in the guiding and conveying of webs or sheets of material. The main problem is to guide the web or sheet of material floatably—i.e., without physical contact with the elements acting upon said web or sheet. The web or sheet of material must be guided not only over rectilinear conveying distances, but also over arcuate conveying distances. These demands can be met only by using nozzles supplied with blowing air and disposed in a nozzle body. The nozzles can be so designed that they not only guide the web or sheet of material free from contact, but also exert a pulling force which can be used for conveying or else tightening the width of the web or sheet of material. However, such demands cannot be met by simple nozzle apertures in a nozzle body, since they achieve no clearly-defined flow-off of the blowing air. For this reason nozzles have been developed which ensure a clearly defined flow-off of the blowing air as a result of their geometrical design (German Patent Specification 19 07 083). Said nozzles are formed by an arcuate incision in the nozzle body, the zone disposed inside the arch lying in the form of a tongue-shaped nozzle lip in the plane of the nozzle body surface, while the zone disposed outside the arch is depressed trough-shaped. When blowing air is applied, a swelling flow emerges from the resulting slot-shaped nozzle aperture and leads to a negative pressure at the tongue-shaped nozzle lip lying in the plane of the nozzle body surface, with the risk that the web of material will touch said nozzle lip, the result being wear on the nozzles and detrition of the surface of the web of material. This makes the use of such nozzle bodies questionable for various applications requiring the highest purity. There is also the aspect that the sharp-edged nozzle lips cause a risk that the web of material will be torn off.

It is an object of the invention to provide a device for floatably guiding webs and sheets of material to be conveyed which has greater security against contact than the prior art device.

This problem is solved according to the invention in a device of the kind specified by the features that the deflecting surface is part of the generated surface of a conical depression in the nozzle body, and the nozzle aperture is disposed eccentrically in the depression with a direction of the blowing air jet directed at a blowing angle of less than 90° to parallel with the deflecting surface.

The device according to the invention eliminates the tongue-shaped nozzle lips which are required by the prior art for the shaping and alignment of the direction of the jet of blowing air and which led to frictional contact with the web of material. Merely the eccentric arrangement of the nozzle aperture in a conical depression with a correspondingly directed direction of the blowing air jet ensures that the blowing air emerges in the form of a swelling flow in a clearly-defined sector. The selection of the blowing angle determines whether the device should be more concentrated on. conveying or on suction. The larger the blowing angle., the larger is the sector of the swelling flow, so that the suctional forces increase and the conveying forces are reduced. The maximum conveying effect is achieved if the direction of the blowing air jet extends parallel with the deflecting surface.

If no conveying effect is needed, the quality of contactless guiding can be further improved by the feature that each nozzle has a number of nozzle apertures each having a tangential component of the direction of the blowing air jet, the tangential component of the direction of the blowing air jet of all the nozzle apertures being in the same direction. In that case a spirally extending swelling flow is produced over the whole periphery of the conical depression.

There are a number of possibilities for the construction of the nozzles:

In a first alternative the nozzle body is made of sheet metal and the nozzles are formed in the sheet metal. In a second alternative the nozzle body is solid and the nozzles are formed in the nozzle body by chip-removing shaping. In a third alternative each nozzle is formed by a shaped body which is inserted into the more particularly sheet metal nozzle body. This alternative is more particularly suitable for long production runs.

The device according to the invention can be differently constructed in dependence of the field in which it is to be used. If the webs or sheets of material are merely to be guided, the nozzle body can take the form of a blowing strip having nozzles disposed in a row transversely of the guiding direction. If the object is at the same time to achieve a width tightening effect, the direction of the blowing air jet of the nozzles in the central portion of the strip extends perpendicularly to the longitudinal axis of the nozzle body and from that portion merges in steps into a direction directed towards the ends and parallel with the longitudinal axis of the nozzle body. If a conveying effect is to be exerted on the sheets of material, the direction of the blowing air jet of all the nozzles is substantially in the same direction. The intensity of guiding/conveying can be influenced by a varying density of the nozzles in the nozzle body.

The nozzle bodies can also be designed on the air cushion principle. In one application of the invention, for example, the nozzle body is constructed in the form of an arcuate deflecting body having on the principle of an air cushion at least one row of nozzles disposed on each of its two edges extending transversely of the conveying direction. If a number of rows are disposed on each edge, the nozzles of the two rows should be offset in relation to one another.

The nozzle body can also be used for the overlapping of sheets to be deposited in succession in a system having a floating strip disposed above a stack of sheets following a conveying path, more particularly with a transverse cutter. For this purpose more particularly a nozzle body is used in which each nozzle has blowing apertures disposed symmetrically around the centre.

Figure 5A:
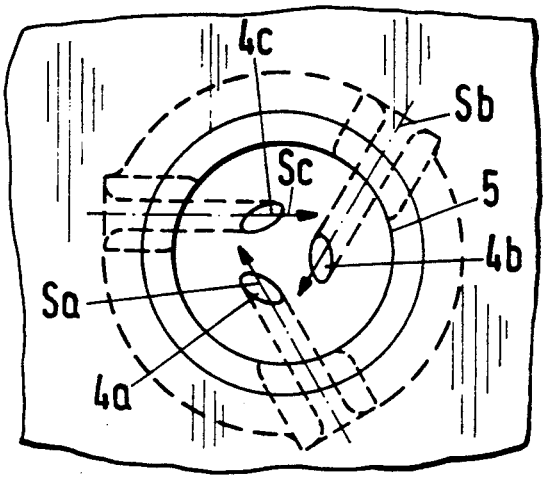
Figure 6:
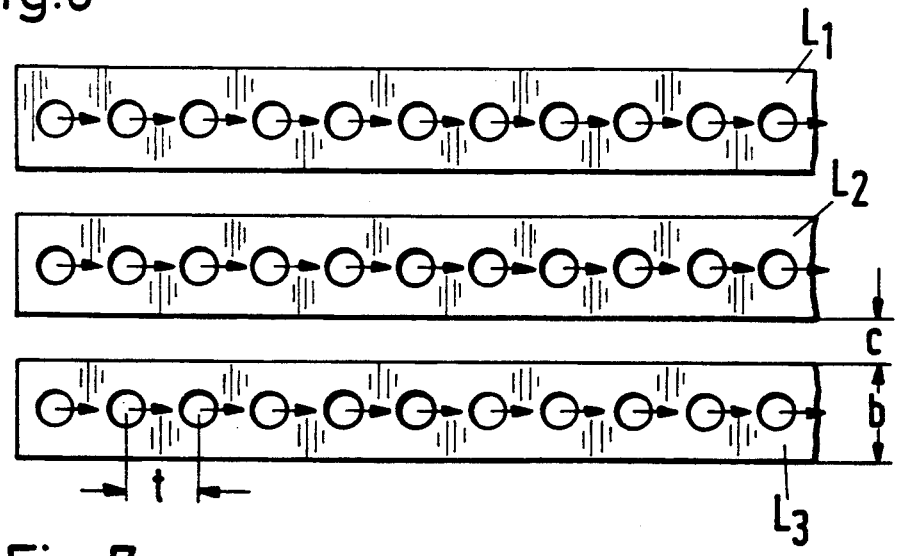
Figure 7:
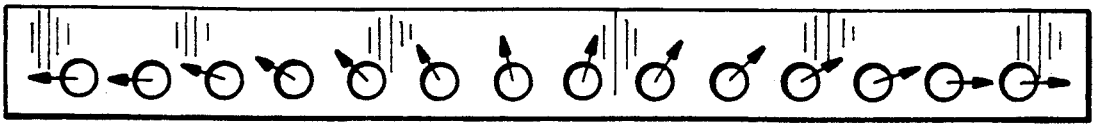
Figure 8:
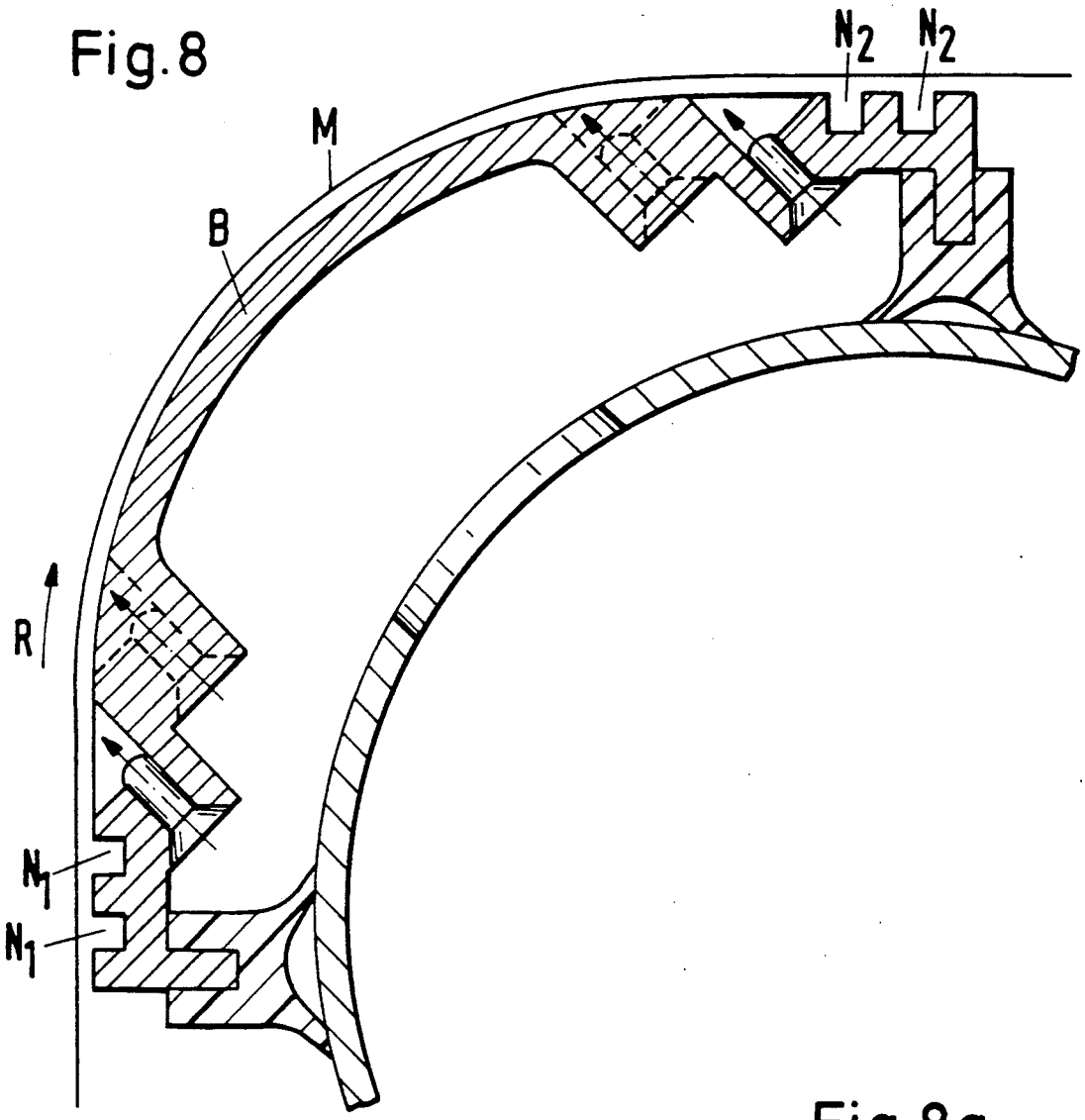
Figure 8A:
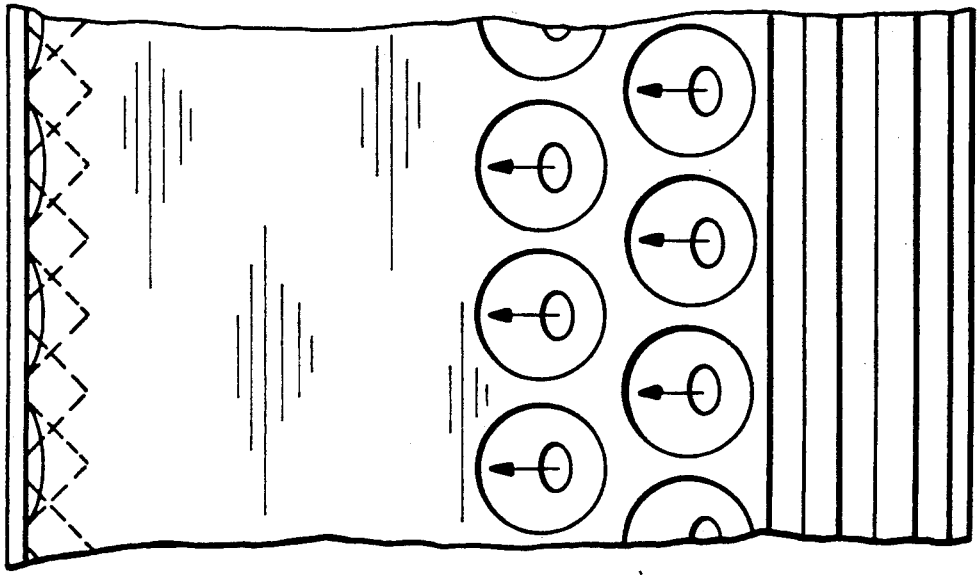

Embodiments of the invention will now be explained in greater detail with reference to the accompanying diagrammatic drawings, wherein:

FIG. 1 is a cross-section through a detail of a nozzle body of solid material, FIG. 1*a* is a plan view of a nozzle body as in FIG. 1, FIG. 2 is a cross-section through a sheet metal nozzle body, FIG. 2a is a plan view of the nozzle body as in FIG. 2, FIG. 3 is a cross-section of a detail of a sheet metal nozzle body with the nozzle inserted, FIG. 3a is a plan view of the nozzle body as in FIG. 3, FIG. 4 is a cross-section through a detail of a nozzle body which is a slight variant of the nozzle body shown in FIG. 3, FIG. 4a is a plan view of the nozzle body as shown in FIG. 4, FIG. 5 is a cross-section through a detail of a nozzle body with inserted nozzle in a construction which is a variant of FIGS. 3 and 4, FIG. 5a is a plan view of the nozzle body as shown in FIG. 5, FIG. 6 is a plan view of a number of nozzle bodies formed as strips and forming a guiding and conveying table, FIG. 7 is a plan view of a strip-type nozzle body having a width-tightening effect, FIG. 8 is a cross-section through a nozzle body taking the form of an arcuate deflecting body, and FIG. 8a is a plan view of a detail of the nozzle body shown in FIG. 8.

In the following description like elements in the various embodiments have like references.

In the embodiment illustrated in FIGS. 1 and 1a, a nozzle supplied with blowing air is formed by chip-removing shaping in a solid nozzle body 1 having a flat side 2 adjacent a web M of material to be guided and conveyed. The nozzle has a conical depression 3 and an eccentric nozzle aperture 4 having a direction S of a blowing air jet which extends parallel with the adjoining deflecting surface 3a of the generated surface 3b of the conical depression 3. An angle $\alpha$ (FIG. 1) is formed between diametrically opposing generating lines of conical depression 3. The angle $\alpha$ denotes the opening angle of conical depression 3.

The blowing air emerges in the form of a sector angle (FIG. 1a) over the adjacent edge 5 of the conical depression and on to the web M of material.

The embodiment illustrated in FIGS. 2 and 2a differs from that shown in FIGS. 1 and la merely by the feature that the nozzle body 1 is made of sheet metal and the nozzle is formed by the deformation of the sheet metal.

The embodiments illustrated in FIGS. 3, 3a; 4, 4a differ from that shown in FIGS. 2 and 2a by the feature that the nozzle is formed by a shaped member F inserted in a recess in the sheet metal nozzle body 1. Another difference is that the direction S of the blowing air jet does not extend parallel with the deflecting surface 3a, but encloses therewith a blowing angle 62 (FIG. 3) between the direction S and the opposing generating line of the conical depression 3, which blowing angle $\beta$ is smaller than 90°. The embodiment illustrated in FIGS. 4 and 4a moreover differs from that shown in FIGS. 3 and 3a by the upper zone of the conical depression 3 having a larger opening angle than the lower zone.

The embodiments illustrated in FIGS. 5 and 5a correspond to that shown in FIGS. 3 and 3a, with the difference that not one only, but three nozzle apertures 4a, 4b, 4c are provided, and the directions $S_a$, $S_b$, $S_c$ of the blowing air jet also have a tangential component, the tangential components being in the same direction. In this embodiment a spiral swelling flow is produced over the whole edge 5.

In the embodiment illustrated in FIG. 6, nozzle bodies corresponding to FIGS. 1 to 4a are constructed in the form of parallel strips $L_1$, $L_2$, $L_3$. Each strip bears a row of nozzles whose resulting jet direction is in the same direction as the swelling flow. To guide and convey webs or sheets of paper having a weight of 50–300 g/m$^2$ it is enough to construct the nozzles in accordance with FIGS. 1 or 2 and the following dimensions $\alpha=90°$, K=25 mm, d=4 mm, t=50 mm, b=70 mm, c=30 mm, if the nozzles are operated with a blowing air pressure of 1/100 bar.

A construction as illustrated in FIG. 3 is recommended with strips operating as a floating ceiling overhead, below which the web of material is guided and conveyed suspended. If the material is heavily air-permeable, a construction is recommended such as that shown in FIG. 4, with an air pressure raised to 1/50 bar.

In the nozzle body constructed in the form of a strip and shown in FIG. 7, nozzles are inserted in accordance with one of the embodiments 1 to 4a. In contrast with the strips illustrated in FIG. 6, however, the resulting directions of the blowing air are not identical, but disposed substantially perpendicularly to the axis of the strip in the zone of its centre, said directions then merging towards the end in steps into a direction parallel with the axial direction of the strip. By such a nozzle body a width-tightening effect is exerted on the web of material. The reason for stepping the direction in the direction of the ends up to parallel with the axial direction is because otherwise the additive lateral forces exerted by the individual nozzles would be excessive in the centre.

In the embodiment illustrated in FIG. 8, which is used for the contactless deflection of a web of material to be guided out of a first plane into a second plane, the nozzle body extends perpendicularly of the conveying direction and has at each of its two edges extending transversely of the conveying direction two rows of nozzles corresponding to the embodiment shown in FIGS. 1 and 1a, the nozzles of adjacent rows being offset via half a pitch in relation to one another. Between the edges the nozzle body has an arcuate deflecting member B. The blowing air jets from the nozzles at the two edges are directed towards one another, so that in conjunction with the web M of material to be guided, an air cushion bearing the web M builds up between the edges. Preferably disposed in the conveying direction R of the web M of material the nozzles at one edge and the nozzles at the other edge are followed by open channels $N_1$, $N_2$ which extend transversely of the conveying direction and open towards the web M of material and are intended to counteract the Bernoulli effect of air flowing off between the nozzles with a small distance from the web of material. Tests carried out on such a device for the deflection of a web of material have shown that the web of material can be deflected contact-free with a narrow distance and with less than half the blowing air energy in comparison with conventional deflections. A pull of 35 kg per 1 m of width was exerted on the web of material, the nozzles being supplied at a pressure of 0.08 bar. The radius of curvature of the arcuate deflecting body B was 60 mm, while the other dimensions of the nozzles were as follows: $\alpha=90°$, K=12 mm, t=15 mm, d=5 mm.

What I claim:

1. A device for floatably guiding webs or sheets of material to be conveyed, using nozzles supplied with blowing air which are disposed in a nozzle body (1) and each having at least one nozzle aperture (4) from which a jet of blowing air emerges and a deflecting surface (3*a*) disposed countersunk in the nozzle body (1) and inclined towards the outside (2) of the nozzle body (1), characterized in that the deflecting surface (3*a*) is part of the generated surface (3*b*) of a conical depression (3) in the nozzle body (1), and the nozzle aperture (4) is disposed eccentrically in the depression (3) with a direction (S) of the blowing air jet directed at a blowing angle of less than 90° to parallel with the deflecting surface (3*a*).

2. A device according to claim 1, characterized in that the blowing angle is smaller than 60°.

3. A device according to claims 1 or 2, characterized in that each nozzle has a number of nozzle apertures (4*a*, 4*b*, 4*c*) each having a tangential component of the direction ($S_a$, $S_b$, $S_c$) of the blowing air jet, the tangential component of the direction ($S_a$, $S_b$, $S_c$) of the blowing air jet of all the nozzle apertures (4*a*, 4*b*, 4*c*) being in the same direction.

4. A device according to claim 1, characterized in that the nozzle body (1) is made of sheet metal and the nozzles are formed in the sheet metal.

5. A device according to claim 1, characterized in that the nozzle body (1) is solid and the nozzles are formed in the nozzle body by chip-removing forming.

6. A device according to claim 1, characterized in that each nozzle is formed by a shaping member (F) which is inserted in the nozzle body (1).

7. A device according to claim 1, characterized in that the nozzle body (1) takes the form of a strip having nozzles arranged in a row.

8. A device according to claim 7, characterized in that the direction (S) of the blowing air jet of all the nozzles is substantially in the same direction.

9. A device according to claim 7, characterized in that the direction of the blowing air jet of the nozzles in the central portion of the strip extends perpendicularly to the longitudinal axis of the nozzle body and from that portion merges in steps into a direction directed towards the ends and parallel with the . longitudinal axis of the nozzle body (1).

10. A device according to claim 1, characterized in that the nozzle body is constructed in the form of an arcuate deflecting body (B) having on the principle of an air cushion at least one row of nozzles disposed on each of its two edges extending transversely of the conveying direction (R).

11. A device according to claim 10, characterized in that a number of rows of offset nozzles are provided on each edge.

* * * * *